US007605335B2

(12) United States Patent
Hiltl et al.

(10) Patent No.: US 7,605,335 B2
(45) Date of Patent: Oct. 20, 2009

(54) POSITION SWITCH

(75) Inventors: Bernhard Hiltl, Kümmersbruck (DE); Werner Puri, Nürnberg (DE); Joachim Seidl, Sulzbach-Rosenberg (DE); Rudolf Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 282 days.

(21) Appl. No.: 11/822,135

(22) Filed: Jul. 2, 2007

(65) Prior Publication Data

US 2008/0017492 A1 Jan. 24, 2008

(30) Foreign Application Priority Data

Jul. 3, 2006 (EP) ..... 06013743

(51) Int. Cl.
*H01H 27/00* (2006.01)
*H01H 9/00* (2006.01)

(52) U.S. Cl. ..... 200/43.04; 200/43.07; 200/318; 200/61.62; 200/334

(58) Field of Classification Search ..... 200/17 R, 200/43.01, 43.04, 43.07, 43.09, 43.11, 43.16, 200/43.19, 318–325, 329, 61.62, 334
See application file for complete search history.

(56) References Cited

U.S. PATENT DOCUMENTS 5,473,127 A * 12/1995 Falcon et al. ..... 200/43.04
5,584,378 A * 12/1996 Wecke et al. ..... 200/43.04
5,777,284 A * 7/1998 Mohtasham ..... 200/43.04
6,037,551 A * 3/2000 Fukui et al. ..... 200/43.04
6,194,674 B1 * 2/2001 Fukui ..... 200/43.04
6,307,167 B1 * 10/2001 Kajio et al. ..... 200/43.11
6,310,305 B1 * 10/2001 Kamino et al. ..... 200/43.11
6,720,508 B2 * 4/2004 Moriyama et al. ..... 200/200
6,872,898 B2 * 3/2005 Mohtasham ..... 200/43.01
6,982,391 B2 * 1/2006 Da Dalt ..... 200/43.04
7,223,927 B2 * 5/2007 Poyner ..... 200/43.04
7,271,355 B2 * 9/2007 Yu ..... 200/17 R
7,345,252 B2 * 3/2008 Takenaka et al. ..... 200/334

FOREIGN PATENT DOCUMENTS

| | | |
|---|---|---|
| DE | 697 06 775 | 9/2001 |
| DE | 100 41 129 C1 | 12/2001 |
| DE | 199 37 947 C2 | 4/2003 |
| EP | 1 533 826 A1 | 5/2005 |
| FR | 2 692 648 | 12/1993 |

* cited by examiner

*Primary Examiner*—Michael A Friedhofer
(74) *Attorney, Agent, or Firm*—Harness, Dickey & Pierce, P.L.C.

(57) ABSTRACT

A position switch is disclosed, with a plunger. In at least one embodiment, the plunger can be moved, via an actuator, from a rest position to an operating position by way of a first rotatable locking element. A second rotatable locking element is usable to block the first rotatable locking element by way of the plunger. A position switch is specified, which separates the actuating mechanism for a switch unit from the holding-shut mechanism and, in doing so, guarantees reliable holding-shut, which manages with a low number of components. Here, the plunger is designed to contact an active surface of the first locking element in the operating position and to contact an active surface of the second locking element in the rest position. The first locking element is able to block the second locking element by way of the plunger and vice versa.

20 Claims, 5 Drawing Sheets

POSITION SWITCH

PRIORITY STATEMENT

The present application hereby claims priority under 35 U.S.C. §119 on European patent application number EP 06013743 filed Jul. 3, 2006, the entire contents of which is hereby incorporated herein by reference.

FIELD

Embodiments of the invention generally relate to a position switch with a plunger. For example, it may relate to one wherein the plunger can be moved by way of an actuator from a rest position to an operating position by way of a first rotatable locking element, and with a second rotatable locking element to block the first rotatable locking element by way of the plunger.

BACKGROUND

Position switches are used in the industrial and in the private sector and serve to safeguard a danger area, such as is defined by a machine or production system, for example, with which danger is associated. Examples of the use of position switches of this kind are in safety engineering, systems engineering, automation engineering and also in building services engineering. In this environment, doors, flaps or other moving objects, for example, which are used to gain access or entrance to parts of the machine or production system, must be safeguarded.

For example, the particular object may be detected in the safeguarded position and, if necessary, can be latched in the safeguarded position by way of a holding-shut device. For this purpose, an actuator is usually attached to the movable object, which is localized in the position switch in the safeguarded position. The position switch in turn detects the presence of the actuator and, if necessary, can trigger a holding-shut device when the actuator is detected.

A holding-shut device, that is to say a latching of the actuator in the position switch, is expedient when after removal of the object from the safeguarded state, such as for example the opening of a door to be safeguarded, the machine causing the danger cannot be switched off directly in a timely manner before a user is able to move into the danger area.

In the past, a range of different position switches has been developed for these or similar applications. Here, the holding-shut mechanism is generally realized by way of a drive based on spring force or a drive based on magnetic force, in both cases the drive being intended for blocking the first rotatable locking element and thus for latching the actuator.

Furthermore, position switches are known, which have switch units, which are at least partially actuated by the actuator, thus indicating the operational state when triggered, in which the actuator must be mounted but not necessarily latched in the first rotatable locking element. Further, the position switch can have a switch unit, which can be at least partially actuated by a solenoid power drive. If the solenoid power drive is used both for the holding-shut device and also for triggering at least one switch element of the switch unit, then this can be used to indicate whether the system is being held shut or not.

The actuation of the switch elements by the solenoid power drive has often proved to be difficult, as large switch travel distances are usually required. In addition, it is desirable to use six or multi-pole switches while deploying standard switch elements, wherein an appropriate switching force must be applied, which must be guaranteed by the control and supply of the solenoid power drives via an ASI bus or additional power supply. With standard switch elements, a separate actuation of switch elements arranged in series is the only suitable method of avoiding this disadvantage, in a similar way to cruciform lever switches. In most cases, coils with higher powers are absolutely essential, as the necessary magnetic forces can only be realized using a correspondingly high current consumption.

For safety reasons, the holding-shut action must be guaranteed when locking the actuator using the solenoid power drive. For this purpose, it is often required to lock the actuator in the inserted state only when the coil is energized. If the coil is not energized, then the position switch releases the latch. This is expedient, for example, in the case of a power failure, in which the safety area must remain accessible even when the power supply is not available. The reverse case can also be relevant in which the interlocking holding-shut device latches the actuator in the inserted state when the coil is not energized. Depending on the application, this effects the exact opposite, namely the safety area is also inaccessible during a power failure. This last variant is expedient, for example, when there is a danger, which originates from electrical equipment running on, or from hazards, which do not originate from electrically driven machines, equipment or systems. The holding-shut device of the position switch must also guarantee that locking when the actuator is not inserted and unlocking of the actuator in the inserted state are reliably prevented.

EP 1 533 826 A1 discloses a position switch, which has a holding-shut mechanism. The holding-shut device works with a locking wheel and a locking element, which are mechanically connected to a large number of components.

SUMMARY

In at least one embodiment, a position switch is disclosed which has a reliable switching behavior and a structure which uses a low number of components.

With a position switch of at least one embodiment, a past problem may be improved upon or even solved in that the plunger may be designed to contact an active surface of the first locking element in the operating position and to contact an active surface of the second locking element in the rest position.

In at least one embodiment, the invention is based on the knowledge that a separation of the forces of the mechanisms for actuating (by the actuator) and locking (by the holding-shut device) is advantageous. Consequently, the so-called actuator-actuating switch elements, also referred to in the following as actuator switch elements, are completely separate from the drive, in particular its armature, with regard to their forces. The holding-shut device is locked exclusively by the drive by means of magnetic or spring force.

According to at least one embodiment of the invention, the position switch has a plunger, which can be used by a second rotatable locking element to block a first rotatable locking element. In the blocked state, the first rotatable locking element, for example a ratchet wheel, is designed to latch an actuator. If the first locking element and the actuator are blocked, then the position switch is in the operating position with the holding-shut device closed. When the holding-shut device is open, the plunger is also forced into an operating position due to the effect of spring force, whereby, due to the spring force, the plunger is brought into contact with an active surface of the first locking element.

The bringing into contact refers to a blocking of the rotational movement of the first locking element by friction being achieved by the plunger via the active surface. This is only possible in the inserted state of the actuator and in a corresponding position of the first locking element, and leads only to the blocking of the first locking element by friction, whereby the frictional blocking can be removed by rotating the first locking element, in particular by moving the actuator.

If the actuator is not located in the position switch, then the plunger remains in the rest position and cannot be brought into contact with the active surface of the first locking element. Instead, in the rest position, the plunger comes into contact with an active surface of the second locking element and locks this in a similar way to that in which the plunger blocks the first locking element in the operating position when a positive engagement with the plunger has been brought about by the second locking element.

Because of the positive locking, a movement, in particular a removal, of the actuator from the position switch is not possible. Consequently, locking by the holding-shut device in the rest position is likewise impossible due to the blocking of the second rotatable locking element. The holding-shut device can only be activated when the plunger can be blocked in the operating position and the second locking element can be rotated for this purpose. This can be carried out by a solenoid power drive for example.

When the holding-shut device is closed, neither the actuator, the first rotatable locking element nor the plunger can be moved. However, it remains possible to move, in particular rotate, the second locking element in active mechanical association with a drive. The first locking element is designed for movement by the actuator and the second locking element for movement by the drive.

Here, switch units, which can be triggered by the actuator without at the same time being tied to the solenoid core or to split cores by way of force, prove to be advantageous, as a result of which a degradation of the magnetic characteristics of the position switch due to actuation is avoided. Furthermore, by separating the armature from the actuating mechanism of the switch unit, it is possible to use more powerful solenoids in the same space and with the same electrical supply. Alternatively, a smaller, narrow design of the position switch can be implemented. For the same reason, the use of snap-action switch elements as actuator switch elements is also possible. Large actuation distances of the actuator switch elements no longer present a problem and, in addition, a large number of poles or contacts can be used by using at least two switch units.

In an advantageous embodiment with switch elements arranged in series, a small, narrow design of the position switch can be realized with a large number of poles and small coil. Greater variation is also possible for the coil, which can be designed more efficiently, more easily and more cost-effectively.

In an advantageous embodiment, standard switch elements, which become usable because of the separation of the two force flows from the actuator and from the solenoid power drive, are used. In addition, the mechanics can also be constructed from simple parts, as the actuator mechanism is decoupled from the drive. The use of different switch elements is likewise uncritical for the same reason (two-pole, three-pole etc.).

In an advantageous embodiment, the holding-shut force of the position switch in unlocked operation can be adjusted by way of the plunger spring. This holding-shut force is consequently also independent of the drive characteristics.

Advantageously, the second locking element of the position switch can be moved, in particular rotated, by way of a spring force drive or solenoid power drive so that the second locking element does not have to be securely connected to the plunger. This further improves the separation of the actuator mechanism for actuating the switch unit from the holding-shut mechanism and particularly its drive.

In an advantageous embodiment, the positive connection of the second locking element to an element of the spring force drive or the solenoid power drive leads to a very reliable connection or reliable locking of the position switch.

In an advantageous embodiment, the first and second locking element have at least one active surface in a recess, for example, for partially accommodating the plunger. The recess provides a reliable mechanical connection and can, for example, be perpendicular to the rotational movement or can oppose the rotational movement or can support any combination of these directions. A recess prevents the plunger from sliding down, for example under the action of larger non-operational forces. Alternatively or in addition, at least one active surface can be provided as a stop for the plunger.

In an advantageous embodiment, the position switch has at least one switch unit with at least one switch element. One switch unit can be triggered by the holding-shut drive, for example, and a further switch unit by the actuation of the position switch by way of the actuator. Here, both switch units can have a plurality of poles or contacts, which make contact or break contact accordingly when triggered.

In an advantageous embodiment, the positive connection between plunger and the switch unit has a substantially angle-iron-like shape in order to bypass essential components of the position switch with regard to force.

Further advantageous embodiments and preferred improvements of the invention can be seen from the description and the figures, and/or from the claims.

BRIEF DESCRIPTION OF THE DRAWINGS

The invention is described and explained in more detail below with reference to example embodiments shown in the figures. In the drawings.

DETAILED DESCRIPTION OF THE EXAMPLE EMBODIMENTS

Figure 1:
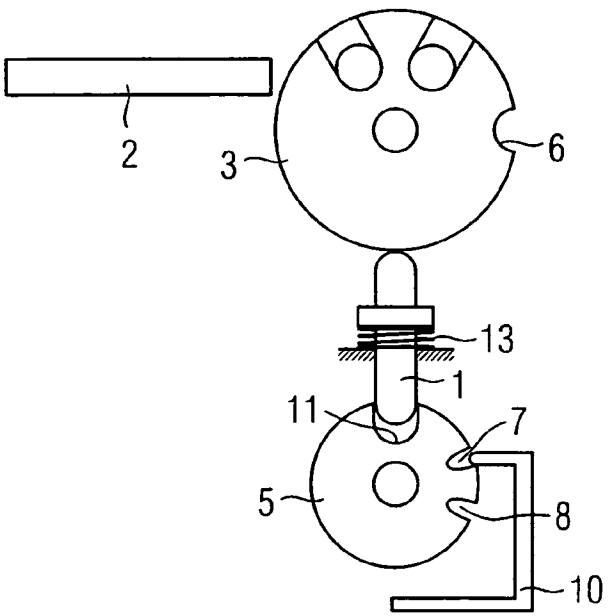
FIG. 1 shows a schematic diagram of an embodiment of a holding-shut device of a magnetic-force-locking position switch in the rest position.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described. Like numbers refer to like elements throughout. As used herein, the terms "and/or" and "at least one of" include any and all combinations of one or more of the associated listed items.

FIG. 1 shows a schematic diagram of an embodiment of a holding-shut device of a magnetic-force-locking position switch in the rest position. Magnetic-force locking refers to the actual locking movement being executed by a magnetic force, which is opposed by a spring force. The rest position of the position switch is a state, which corresponds to the non-operation of a machine with which danger is associated, in which the safety area can be entered without risk. For example, a safety door would be in the open state, as the actuator 2 would have to be mounted on the safety door—that is to say outside the position switch. In the rest position, a first rotatable locking element 3, which is constructed as a ratchet wheel, is freely movable and ready to accept the actuator 2.

In the rest position, a plunger 1 engages in a second rotatable locking element 5. The second rotatable locking element 5 has a recess 11 and active surfaces therein for this purpose. The second rotatable locking element 5 is positively blocked due to the fact that the plunger 1 engages in the recess 11. In this state, a rotation of the second locking element 5 due to the action of a force of a drive (not shown) via a transmission plate 10 (element of the drive) and a recess 7 provided for this is not possible. The action of any downward force on the transmission plate 10 cannot produce a movement due to the positive engagement of the plunger 1 with the second locking element 5. An activation of the holding-shut device, that is to say a locking of the position switch in this state, is not possible.

The actuator 2 can be fed into the position switch and in doing so causes a rotational movement of the first rotatable locking element 3 and, after the movement, is anchored in the first rotatable locking element 3. After reaching the end position of the actuator 2, the position switch is in the operating state.

Figure 2:
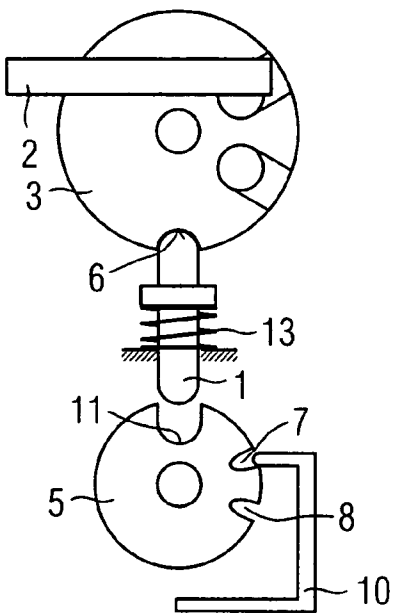
FIG. 2 shows a schematic diagram of an embodiment of a holding-shut device of a magnetic-force-locking position switch in the operating position with open holding-shut device.

FIG. 2 shows a schematic diagram of an embodiment of a holding-shut device of a magnetic-force-locking position switch in the operating position with open holding-shut device. In this state, a spring 13 is able to push the plunger 1 into a recess 6 of the first rotatable locking element 3. This blocks the rotational movement of the first rotatable locking element 3 by friction. Because of the length of the plunger 1 provided, this withdraws completely from the active surface of the recess 11 and allows a rotation of the second locking element 5, i.e. an activation of the holding-shut device. When the first locking element 3 is blocked, the second locking element 5 can be rotated.

In the state shown, the force of the spring pushes the transmission plate 10 against a stop (not shown) and thus defines an upper end position of the transmission plate 10. A magnetic force of the drive is not necessary in this state.

Figure 3:
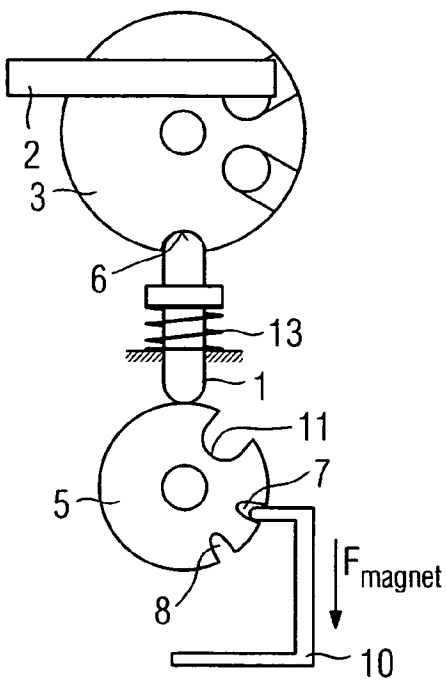
FIG. 3 shows a schematic diagram of an embodiment of a holding-shut device of a magnetic-force-locking position switch in the operating position with closed holding-shut device.

FIG. 3 shows a schematic diagram of an embodiment of a holding-shut device of a magnetic-force-locking position switch in the operating position with closed holding-shut device.

After the downward movement of the transmission plate 10 following an energization of a coil of the solenoid power drive, the second rotatable locking element 5 rotates, driven by the magnetic force via the transmission plate 10, in a clockwise direction so that the recess 11 and its active surface can no longer be reached by the plunger 1. In addition, the plunger 1 is deprived of its freedom of movement by the engagement of the second rotatable locking element 5. The plunger 1 is blocked, as also is the first rotatable locking element 3.

Advantageously, in the event of a power failure, the downward movement of the transmission plate 10 is prevented by the absence of magnetic force so that, in the event of a power failure, the position switch can always be moved to the rest position. Thus the danger area remains accessible even in the event of a power failure.

Figure 4:
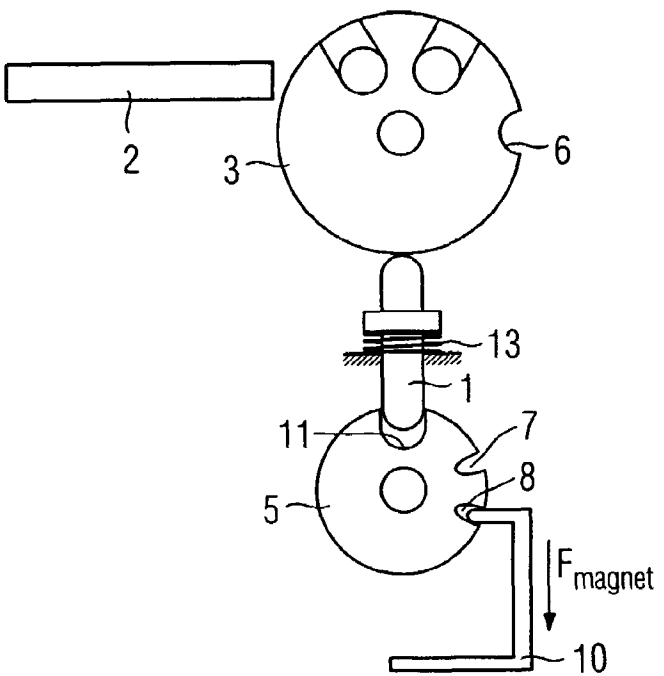
FIG. 4 shows a schematic diagram of an embodiment of a holding-shut device of a spring-force-locking position switch in the rest position.

FIG. 4 shows a schematic diagram of an embodiment of a holding-shut device of a spring-force-locking position switch in the rest position. The holding-shut device corresponds substantially to the holding-shut device shown in FIG. 1. The difference consists in the fact that the transmission plate 10 engages in the recess 8 and is subject to a magnetic force, which overcomes the spring force, and is thus pulled into a bottom end position, which can be realized, for example, by the stop on a yoke or on another component.

Figure 5:
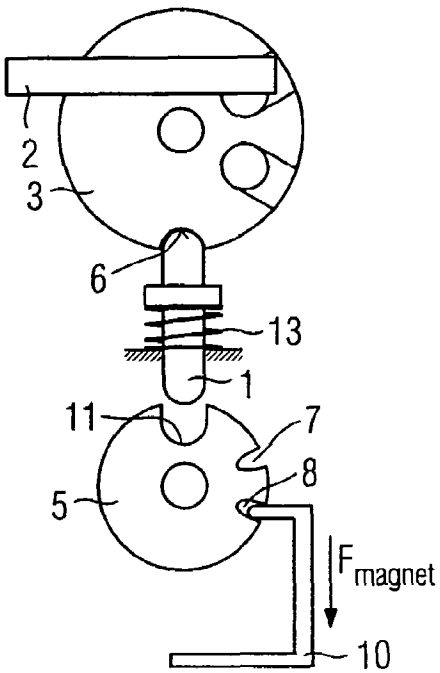
FIG. 5 shows a schematic diagram of an embodiment of a holding-shut device of a spring-force-locking position switch in the operating position with open holding-shut device.

FIG. 5 shows a schematic diagram of an embodiment of a holding-shut device of a spring-force-locking position switch in the operating position with open holding-shut device.

The position switch is moved into the operating state in a similar way to FIG. 2. Due to its upward movement, the plunger 1 releases the second rotatable locking element 5 for a rotational movement. The transmission plate 10 does not move upward, as the magnetic force is stronger than the spring force. In this example embodiment, the movement of the second rotatable locking element 5 in the clockwise direction is not desired in this state.

Figure 6:
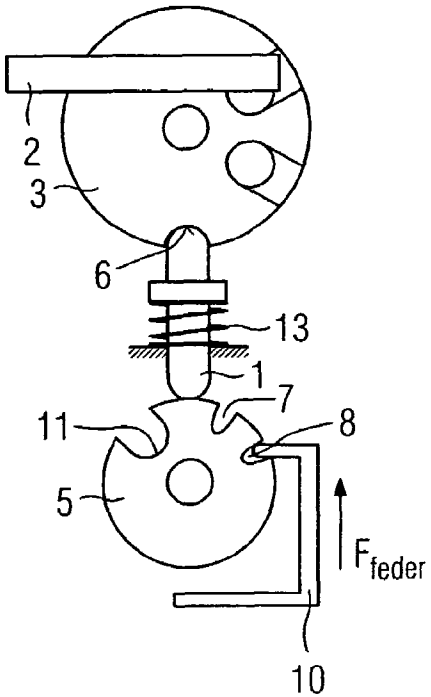
FIG. 6 shows a schematic diagram of an embodiment of a holding-shut device of a spring-force-locking position switch in the operating position with closed holding-shut device.

FIG. 6 shows a schematic diagram of a holding-shut device of a magnetic-force-locking position switch in the operating position with closed holding-shut device.

In order to trigger the holding-shut device, the solenoid power drive (not shown) is lowered or deactivated, whereby the positive connection to an armature leads to an upward movement of the transmission plate 10 by way of the dominating spring force.

Figure 7:
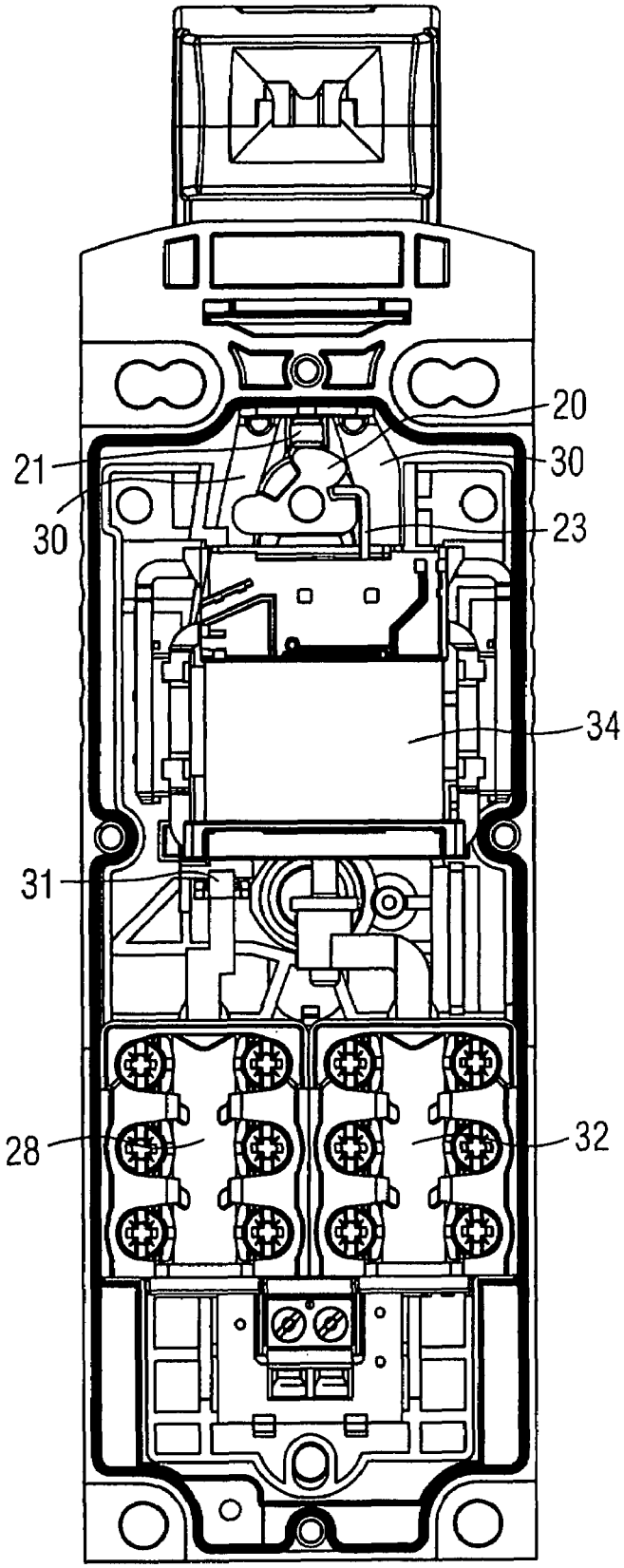
FIG. 7 shows a front view of an example embodiment of a position switch without cover.
Figure 8:
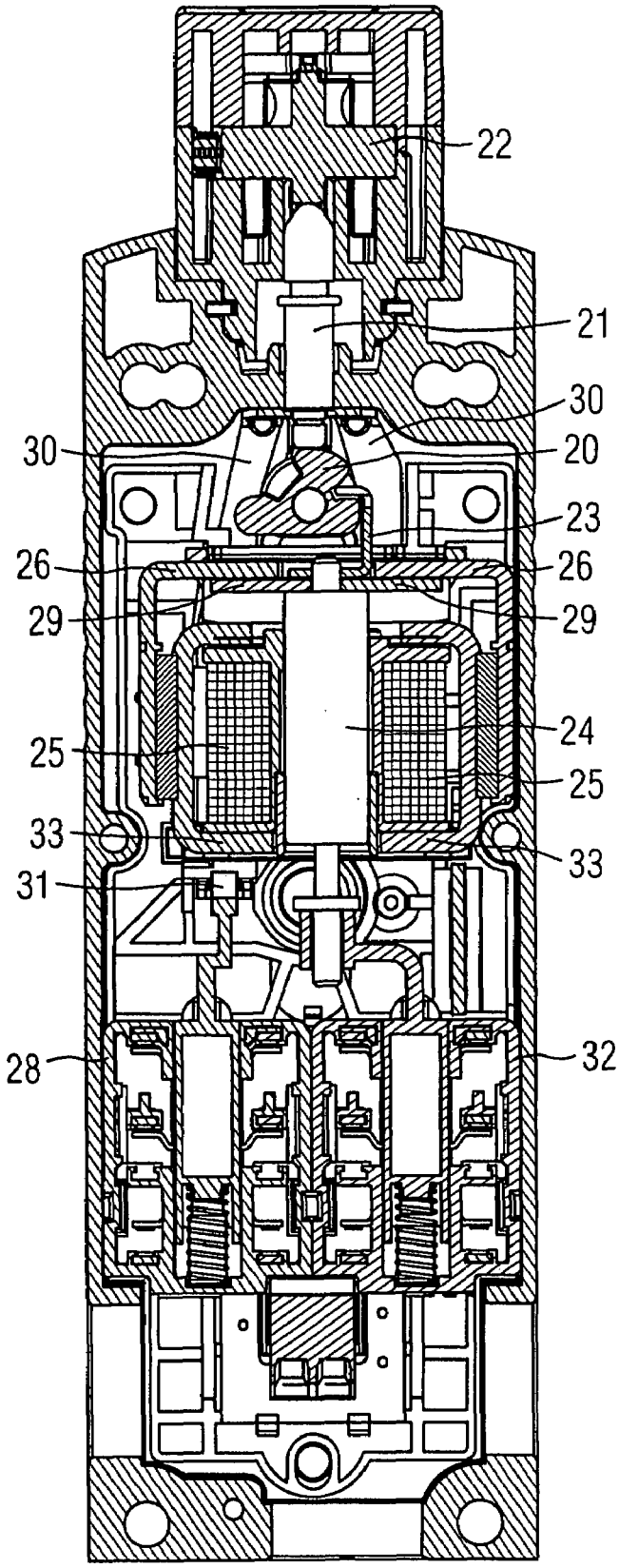
FIG. 8 shows a sectioned front view of the example embodiment of FIG. 7.

FIGS. 7 and 8 show a front view of an example embodiment of a position switch without cover, wherein the position switch is shown sectioned in FIG. 8.

The position switch is designed for use with a separate actuator (not shown). An important component of the holding-shut device of the position switch is the second locking element 20, which is rotatably fixed in the position switch. The second locking element 20 can be blocked by the plunger 21 in combination with a first locking element 22, and can be moved by the solenoid drive 34 by way of an actuating plate 23.

The state of the position switch shown corresponds to the operating state with the holding-shut device locked. In the operating state, i.e. when the machine implying danger is operating, for example, the second locking element 20 is rotated via the actuating plate 23 by an activation of the solenoid drive 34 and moved into the locking position. In this position of the second locking element 20, the plunger 21 is not able to draw back from the first locking element 22 if it were rotated by means of the actuator, the more so as its top end is in contact with the first locking element 22.

The advantageous factor is that only actuation functions (actuated and not-actuated) with regard to the switch element 28 are assigned to the first locking element 22, and holding-shut functions (locked and unlocked) are assigned to the second locking element 20, whereby both locking elements 20, 22 can be locked in a position by the other locking element 20, 22 respectively. The separation of the functions makes it possible to save on a large number of other components, which would cause unnecessary frictional losses and costs.

Also advantageous is the path of the force in the locked state when the (blocked) actuator is improperly handled. In the case of an attempt to remove the actuator in the blocked state, because of the positive engagement, a force is transmitted from the actuator via the plunger 21 to the second locking element 20. It is advantageous that the force is aligned at right angles to the axis of rotation of the second locking element 20 and is therefore absorbed directly and a force component is not diverted to a component, which is possibly prone to breaking or bending.

Furthermore, the position switch has two switch units 28, 32, wherein the left-hand switch unit 28 is actuated by way of a further actuating plate 30, which on the one hand is connected to the plunger 21 and on the other to the left-hand switch unit 28 by way of the foot 31, the foot 31 being formed on the actuating plate 30. The actuating plate 30 is a two-dimensional, angled component, which is designed for spatially bypassing the solenoid drive 34 in particular.

The right-hand switch unit 32 is positively connected to the armature 24 of the solenoid drive 34. The left-hand switch unit 28 is therefore designed to detect the operating state of the position switch, as this can be positively triggered by the plunger 21 or by the separate actuator, wherein positive refers to a force path being guaranteed due to the shapes of the components. In addition, the right-hand switch unit 32 is directly actively connected to the solenoid drive 34 so that it is likewise possible to establish whether or not a holding-shut or a locking action has been implemented by way of the holding-shut device. The states mentioned above can consequently be interrogated by way of the appropriate circuits.

The solenoid drive 34 has a first coil, in the form of the coil 25, and an associated armature 24 with a holding element 29. The holding element 29 is two-dimensional and is designed to make mechanical contact with the outer yoke 26 and the inner yoke 33. The armature 24 is in the rest position when the holding element 29 is in contact with the outer yoke 26, and in the locking position when the holding element 29 is in contact with the inner yoke 33.

The actuating plates 23, 30 are advantageously designed with an angle-iron-like shape, that is to say two-dimensionally with folded edges, as a result of which the mechanical component is able to bypass important components of the position switch. In this way, the actuating plate 30 bypasses the centrally mounted solenoid drive 34 in particular in order to actuate the left-hand switch unit 28 with its foot 31.

Figure 9:
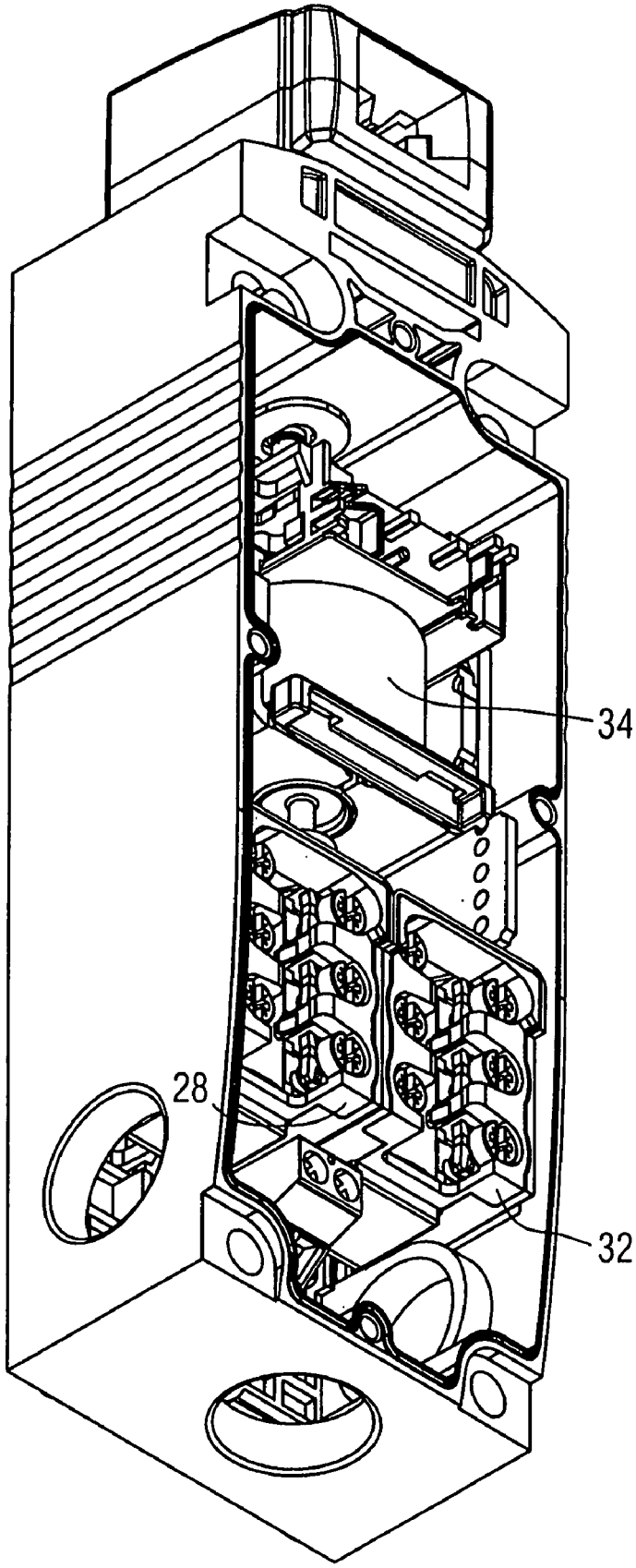
FIG. 9 shows a perspective view of the example embodiment of FIG. 7.

FIG. 9 shows a perspective view of the second example embodiment of FIG. 7, wherein, in particular, the left-hand switch unit 28 and right-hand switch unit 32 and the solenoid drive 34 clearly emerge.

To summarize, at least one embodiment of the invention relates to a position switch with a plunger, wherein the plunger can be moved by way of an actuator from a rest position to an operating position by means of a first rotatable locking element, and with a second rotatable locking element to block the first rotatable locking element by way of the plunger. A position switch is specified, which separates the actuating mechanism for a switch unit from the holding-shut mechanism and, in doing so, guarantees reliable holding-shut, which manages with a low number of components. Here, the plunger is designed to contact an active surface of the first rotatable locking element in the operating position and to contact an active surface of the second rotatable locking element in the rest position. The first locking element is able to block the second locking element by way of the plunger and vice versa.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A position switch, comprising:

a plunger, movable via an actuator from a rest position to an operating position by way of a first rotatable locking element, a second rotatable locking element being usable to block the first rotatable locking element via the plunger, the plunger being designed to contact an active surface of the first locking element in the operating position and to contact an active surface of the second locking element in the rest position.

2. The position switch as claimed in claim 1, wherein the first rotatable locking element is provided for blocking the second rotatable locking element via the plunger and, at the same time, wherein the blocking locking element is movable.

3. The position switch as claimed in claim 2, wherein the first locking element is blocked in the operating position of the plunger.

4. The position switch as claimed in claim 2, wherein the second locking element is blocked in the rest position of the plunger.

5. The position switch as claimed in claim 1, wherein the first locking element is blocked in the operating position of the plunger.

6. The position switch as claimed in claim 1, wherein the second locking element is blocked in the rest position of the plunger.

7. The position switch as claimed in claim 1, wherein the second locking element is movable by way of at least one of a spring force drive and solenoid power drive.

8. The position switch as claimed in claim 7, wherein the second locking element is positively connected to an element of at least one of the spring force drive and the solenoid power drive.

9. The position switch as claimed in claim 8, wherein the second locking element, with the plunger, is provided for blocking and releasing the first locking element in the operating position when at least one of the spring force drive and solenoid power drive is activated.

10. The position switch as claimed in claim 7, wherein the second locking element, with the plunger, is provided for blocking and releasing the first locking element in the operating position when at least one of the spring force drive and solenoid power drive is activated.

11. The position switch as claimed in claim 7, wherein the position switch includes at least one switch unit, including at least one switch element, and wherein a making of at least one contact of the switch element is positively changeable depending on the position of the plunger.

12. The position switch as claimed in claim 11, wherein a positive connection between plunger and the switch unit has a substantially angle-iron-like shape.

13. The position switch as claimed in claim 11, wherein the switch unit includes at least one of at least one switch element for actuation by way of the actuator and a switch element for actuation by way of at least one of the spring force drive and the solenoid power drive.

14. The position switch as claimed in claim 1, wherein the first and second locking elements have at least one of at least one active surface in at least one recess for partially accommodating the plunger, and at least one active surface provided as a stop for the plunger.

15. The position switch as claimed in claim 1, wherein the actuator is latched in the position switch when the first locking element is blocked.

16. The position switch as claimed in claim 1, wherein the second locking element is rotateable by way of at least one of a spring force drive and solenoid power drive.

17. The position switch as claimed in claim 1, wherein the position switch includes at least one switch unit, including at least one switch element, and wherein a making of at least one contact of the switch element is positively changeable depending on the position of the plunger.

18. The position switch as claimed in claim 17, wherein a positive connection between plunger and the switch unit has a substantially angle-iron-like shape.

19. The position switch as claimed in claim 1, wherein the second rotatable locking element is usable to block the first rotatable locking element via the plunger.

20. A position switch, comprising:

a plunger, movable from a rest position to an operating position, designed to contact an active surface of a first locking element in the operating position and to contact an active surface of a second locking element in the rest position.

* * * * *